United States Patent [19]

Pomeret et al.

[11] 4,095,752

[45] * Jun. 20, 1978

[54] MOTORIZED SHOVEL

[75] Inventors: Jean-Claude Pomeret, Saint-Lager; Henry Bonnevaux, Lyons, both of France

[73] Assignee: Societe Civile Particuliere Innovation Promotion S.C.I.P., Anse, France

[ * ] Notice: The portion of the term of this patent subsequent to Jul. 22, 1993, has been disclaimed.

[21] Appl. No.: 723,613

[22] Filed: Sep. 15, 1976

[30] Foreign Application Priority Data

Sep. 17, 1975 France ..... 75 29024

[51] Int. Cl.[2] ..... B66C 23/00

[52] U.S. Cl. ..... 214/151; 212/65; 294/49

[58] Field of Search ..... 214/151, 130 R, 145 R; 212/59 R, 61, 65; 294/49

[56] References Cited

U.S. PATENT DOCUMENTS

| | | | |
|---|---|---|---|
| 1,728,233 | 9/1929 | Edmister | 212/61 |
| 2,974,809 | 3/1961 | Sellars et al. | 212/65 |
| 3,065,557 | 11/1962 | Pewthers | 214/145 |
| 3,367,512 | 2/1968 | Kaplan | 214/130 R |
| 3,964,182 | 6/1976 | Pomeret et al. | 294/49 |

*Primary Examiner*—Drayton E. Hoffman
*Assistant Examiner*—Ross Weaver
*Attorney, Agent, or Firm*—Karl F. Ross

[57] ABSTRACT

A motorized shovel comprises a carriage which may be provided with wheels to enable it to negotiate the ground and is formed with an upright pole carrying an arm adapted to overhang the operator. The arm is swingable about a vertical axis to follow the movements of an operator and carries a pneumatic-motor-driven winch drum adapted to pay out and retract a cable depending from the free end of the arm. The cable is anchored to a shovel unit whose handle is provided with a handle bar adapted to be gripped by the operator. Controls on the handle bar regulate the operation of the winch and of a pneumatic vibrator interposed between the handle and the shovel blade. Flexible conduits run along the downwardly extending stretch of the cable to connect the pneumatic controls to the winch.

8 Claims, 7 Drawing Figures

MOTORIZED SHOVEL

FIELD OF THE INVENTION

The present invention relates to a motorized shovel driven pneumatically and, more particulary, to a digging shovel.

OBJECT OF THE INVENTION

The object of the invention is to provide a light shovel which is guided manually by an operator but which, by virtue of its motorized operation, spares the operator from undertaking considerable muscular work.

The general purpose of the apparatus is to penetrate materials and more particularly the ground, release the latter and eject it, in the case where the use of a large mechanical or hydraulic shovel is not economical, does not make it possible to obtain the desired accuracy or cannot be used because of a lack of space on the ground.

More particularly, this apparatus is intended for removing earth from trenches and other excavations, such as graves in cemeteries, work which normally requires considerable muscular effort, since it is necessary to raise the shovel and its contents and which also requires a certain degree of accuracy owing to the fact that the bottom of a trench is sometimes not easily accessible.

SUMMARY OF THE INVENTION

The motorized shovel according to the invention comprises a shovel unit having a blade and a handle. The latter has handle bars which support the manual control means for a pneumatic drive means. The handle is suspended from a cable wound on a winch drum provided with a pneumatic motor and mounted on an arm extending above the operator and supported by an adjustable pole fixed to a vehicle or part of a vehicle.

Owing to its motorized operation, achieved with an economical power source, e.g. a compressor driven by a gasoline engine, fueled by a widely available substance and easily conveyed, this shovel prevents the operator from having to undertake considerable muscular work, since his role is solely to guide the shovel in the desired direction, the orientation of the pole automatically following the angular movement made by the operator and to actuating the manual control means for bringing about the ascent, descent or stoppage of the shovel unit suspended from the cable.

Advantageously, in addition to the motor of the winch, the pneumatic drive means comprise a vibration or percussion mechanism located at the connection point of the shovel blade and its handle. This additional mechanism improves the efficiency of the shovel, thus facilitating its penetration into the ground or any other material.

According to one feature of the invention, the connection between the manual control means and the pneumatic motor of the winch mounted on the arm, as well as the possible supply of power to the vibration or percussion mechanism, is effected; by flexible tubes connecting the handle of the shovel and the free end of the arm, the tubes running substantially parallel to the cable. Other conduits are naturally provided for connecting the device to an appropriate source of power and in particular a compressor.

According to another feature of the invention, the arm, which is slightly inclined with respect to the horizontal in the normal position for use, is pivoted at the top of the adjustable pole and can be folded into two parts, the pole itself being formed of two parts, one of which can be tilted. These arrangements facilitate transportation of the shovel and its storage, when it is not in use. Preferably, the winch drum as well as its pneumatic motor are fixed to the arm in the vicinity of the point where it is pivoted at the top of the adjustable pole.

BRIEF DESCRIPTION OF THE DRAWING

The invention will be better understood from the following description, referring to the accompanying diagrammatic drawing illustrating an embodiment of the motorized shovel of the invention. In the drawing.

SPECIFIC DESCRIPTION

Figure 1:
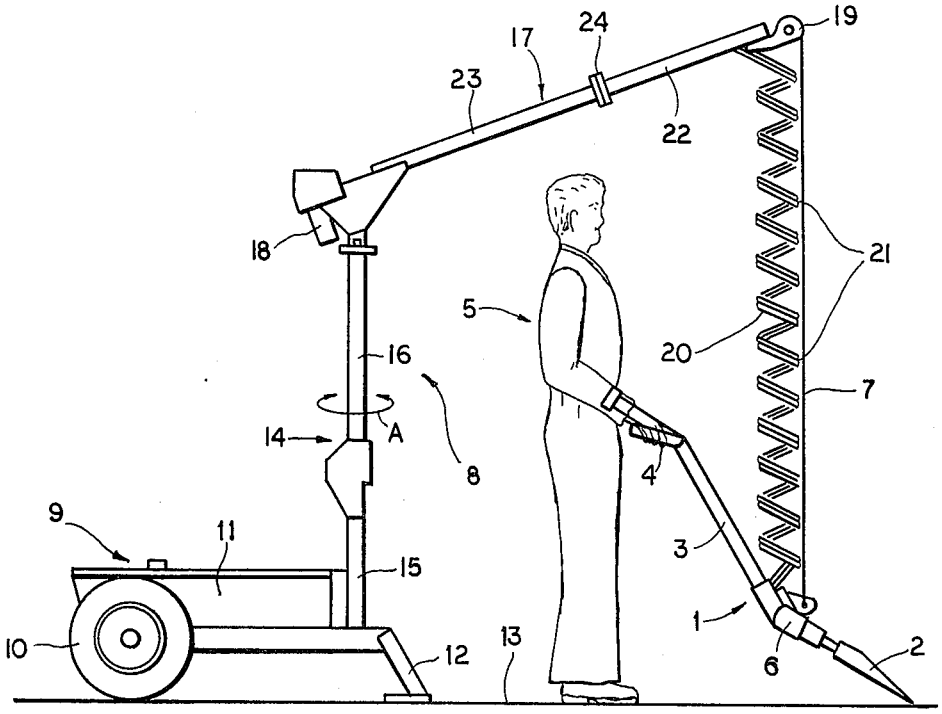
FIG. 1 is a side view of the shovel in the normal position for use.

The apparatus illustrated in FIG. 1 comprises a shovel proper, designated generally by the reference numeral 1 and composed essentially of a shovel blade 2 made from special high-strength steel, connected to a telescopic handle 3 terminating in a handle bar 4 which can be gripped by the operator's hand 5.

In the part where the blade 2 is connected to the handle 3, a pneumatic vibration or percussion mechanism 6 is inserted, the body of which is integral with the handle 3 and whose vibrating part is connected to the shovel blade 2.

The handle 3 of the shovel 1 is suspended at its part adjacent the vibration or percussion mechanism 6 from the end of a cable 7 belonging to a lifting system driven pneumatically, designated generally by the reference numeral 8. In the example in question, this lifting system 8 is mounted on a small weighted carriage 9 equipped with two wheels 10, a small tipping bucket 11 (see FIG. 2) and two retractable legs 12 arranged so as to form on the ground 13, a support polygon of sufficient dimensions with the wheels 10.

The lifting system 8 comprises a vertical pole 14 whose lower part 15 is fixed directly to the chasses of the carriage 9 and whose upper part 16 is adjustable and rotatable about a vertical axis as represented by arrow A. The pole 14 may be telescopic in order to assume various heights according to the work to be undertaken.

Mounted at the top of the pole 14 is an arm 17, which is also preferably telescopic for the same reasons as above and which in the normal position of use, is inclined slightly with respect to the horizontal.

At its end adjacent the top of the pole 14, the arm 17 supports a winch mechanism 18 essentially comprising a pneumatic motor and a drum on which the cable 7 winds. The free end of the arm 17 is provided with a head 19 which is preferably adjustable, supporting a pulley, over which the cable 7 passes.

The pneumatic motor of the winch 18 and the pneumatic vibration or percussion mechanism 6 are connected to a compressor which is not shown, providing the compressed air necessary for the operation of the shovel. The means for the manual control of the winch 18 and mechanism 6 are located on the handle bar 4, their connection to the source of power being ensured by flexible tubes connecting the handle 3 of the shovel 1 to the free end of the arm 17. The tubes 20 are substantially parallel to the cable 7 and to ensure their guidance, they comprise eyelets 21 through which the cable 7 passes.

To use the apparatus, it is only necessary for the operator 5 to guide the shovel 1 in the desired direction, by means of its handle bar, the orientation of the pole 14 and of the head 19 of the arm automatically following the angular movements made by the operator, who makes virtually no muscular effort. Naturally, the operator should at the same time be able to control the two lifting and percussion functions by the manual control means located on the handle bar.

Figure 3:
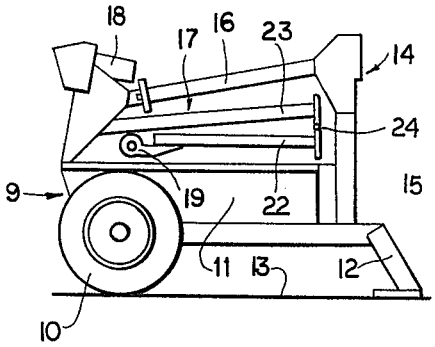
FIG. 3 is a side view of the shovel in the completely folded position for transportation or storage.
Figure 2:
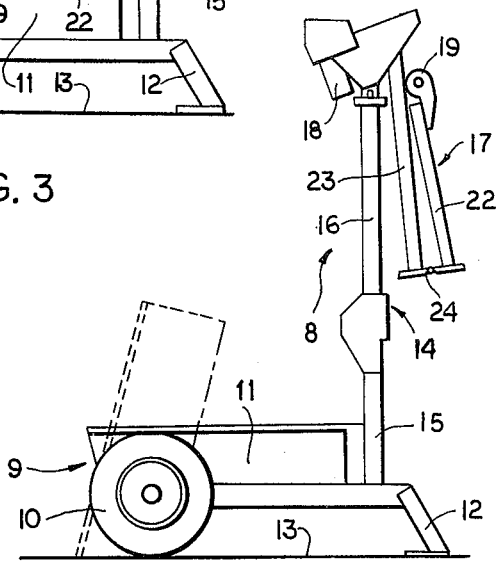
FIG. 2 is a side view of the shovel in the partly folded position.

When the apparatus is not in use, it may be folded as shown in FIGS. 2 and 3, in order to facilitate its storage and transportation from one place to another. To this end, the arm 17 is formed of two parts 22 and 23 connected by a pivot 24, the front part 22 supporting the head 19 being able to be folded back against the rear part 23, as shown in FIG. 2. Furthermore, this rear part 23 is pivoted about a horizontal pivot such that the folded arm arrangement 17 may be brought into a position substantially parallel to the upper part 16 of the pole 14 (see FIG. 2). To achieve minimum bulk, this part 16 may itself be tilted and may be brought into a substantially horizontal position, as shown in FIG. 3, such that all the lifting system 8 is folded above the bucket 11 of the carriage 9.

Figure 4:
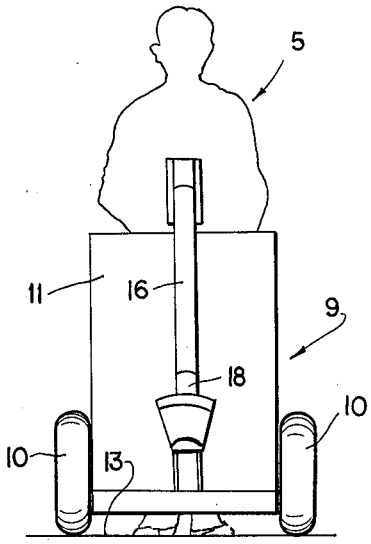
FIG. 4 is a front view of the folded shovel, during transportation.

The arrangement may be easily moved by means of wheels 10 on the carriage 9, which may be pushed easily from one place to another, in the inclined position, by a single operator 5, as shown in FIG. 4.

Figure 5:
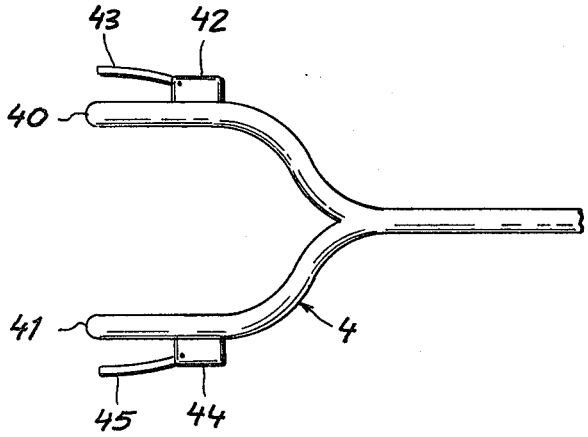
FIG. 5 is a diagrammatic plan view of the handle bar of the shovel unit according to the invention.

As can be seen from FIG. 5, the handle bar 4 of the shaft of the shovel unit can be provided with a pair of handles or grips 40 and 41 each carrying a pneumatic valve 42, 44 operated by an actuating lever 43, 45. Thus one hand of the operator can actuate one of the valves 42 or 44 while the other hand of the operator actuates the other valves.

Figure 6:
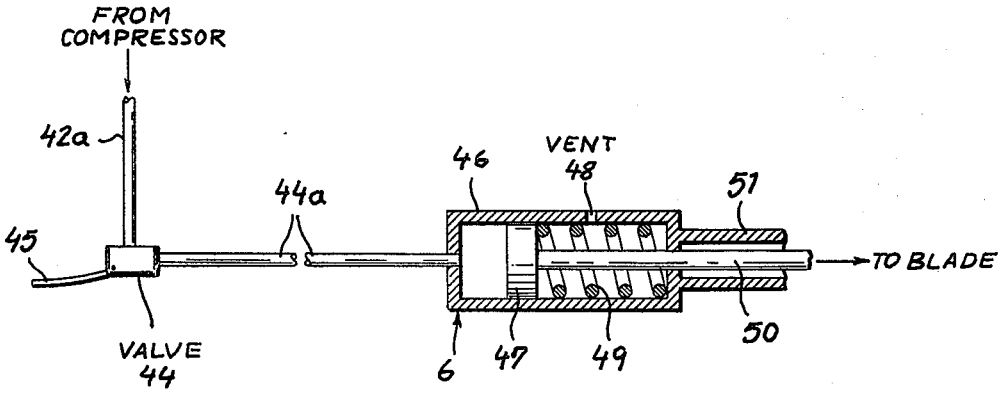
FIG. 6 is a diagrammatic detail view of the control arrangement for the pneumatic vibrator.
Figure 7:
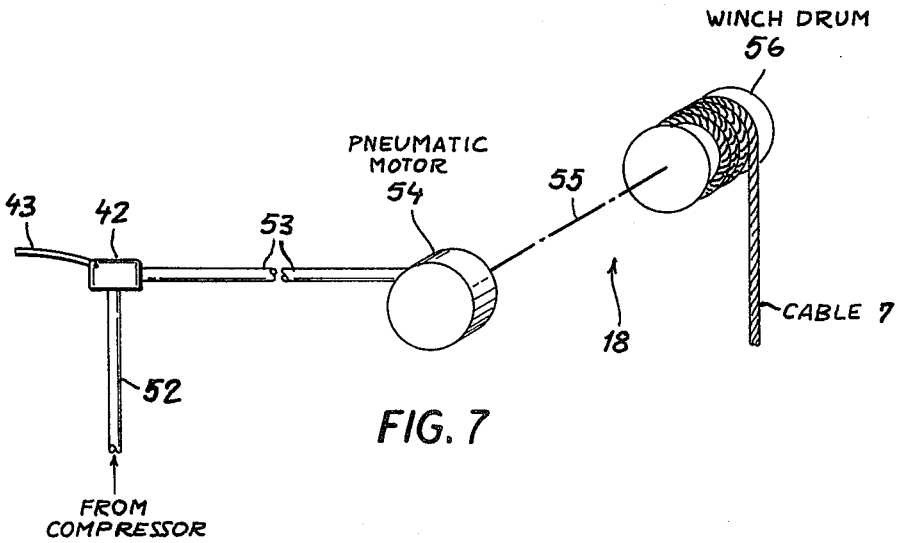
FIG. 7 is a diagrammatic detail view of the control arrangement for the pneumatic motor operating the winch according to the invention.

As can be seen from FIG. 6, the pneumatic valve 44 receives compressed air from the compressor via a line **42*a* and communicates via another line 44*a*, running along the shaft of the shovel unit, with the pneumatic vibrator 6. The latter can comprise a cylinder 46 provided with a vent aperture 48 and receiving a piston 47 which can be displaced to the right via the pneumatic pressure against the force of a spring 49 until the valve opening or vent 48 is unblocked. The spring thereupon pushes the piston 47 to the left and the vibration cycle is repeated. The piston rod 50 is connected directly to the shovel blade and passes through a tubular housing 51** in which the blade is slidably mounted.

The other valve 42 receives compressed air from the compressor via tube 52 and communicates via conduit 53 with a pneumatic motor 54 of the winch unit 18. The shaft 55 of this pneumatic motor drives a winch drum 56 upon which the cable 7 is wound. Conduits **42*a*, 52 and 53 may reconstitute the flexible or coiled conduit assembly represented at 20 in FIG. 1. Actuation of the lever 45 will cause the vibrator 6 to operate whereas actuation of lever 43 will operate the pneumatic motor to raise the cable 7. Release of the lever 53 permits the cable 7 to be lowered by the winch drum 56**.

Naturally, the invention is not limited to the single embodiment of this motorized shovel which has been described above as an example. On the contrary, it includes all variations comprising equivalent means.

Thus, the winch with its pneumatic motor and drum for winding the cable may be mounted at any point on the arm or even on the pole, without diverging from the spirit of the invention and the pole itself may be fixed not only to a weighted carriage but also, depending on the nature of the work, directly to the compressor for the supply of compressed air, on a rail of the lorry receiving the material raised by means of the shovel or more generally, on any suitable vehicle or part of a vehicle. The pole is advantageously fixed in a detachable manner, in order to be able to utilize these various possibilities according to the application envisaged.

I claim:

1. A motorized shovel comprising a support vehicle;
a post extending upwardly from said vehicle;
an arm projecting generally laterally from said post;
a cable extending downwardly from said arm;
a winch assembly provided with a pneumatic motor and adapted to wind up and pay out said cable respectively; and
a shovel unit suspended from said cable and provided with a handle bar formed with a control for operating said pneumatic motor.

2. The motorized shovel defined in claim 1 wherein said shovel unit comprises a shaft connected to said handle bar and a blade mounted on said shaft, a pneumatic vibration means being interposed between said shaft and said blade.

3. The motorized shovel defined in claim 2 wherein said pneumatic motor is mounted on said arm, said motorized shovel further comprising flexible tube means extending along said cable and interconnecting said pneumatic motor with said control.

4. The motorized shovel defined in claim 3 wherein said flexible tube means is formed with guiding eyelets traversed by said cable.

5. The motorized shovel defined in claim 2 wherein said arm is inclined slightly to the horizontal in a normal position of use, said motorized shovel comprising pivot means at the top of said post for articulating said arm to said post said arm comprising a pair of articulated parts capable of being folded together for storage or transportation of the motorized shovel.

6. The motorized shovel defined in claim 5 wherein said post is formed of two parts one of which can be tilted relative to the other.

7. The motorized shovel defined in claim 6 wherein said pneumatic motor and said drum are mounted on said arm substantially at its junction with the top of said post.

8. The motorized shovel defined in claim 6 wherein the lower part of said post is fixed to said vehicle and above which said post and said arm are foldable for storage and transportation.

* * * * *